US006116596A

United States Patent [19]

Gates

[11] Patent Number: 6,116,596

[45] Date of Patent: Sep. 12, 2000

[54] CANTILEVERED BINS SHEET SORTER WITH INCREMENTING END SUPPORT

[75] Inventor: Len Victor Gates, Herts, United Kingdom

[73] Assignee: Xerox Corporation, Stamford, Conn.

[21] Appl. No.: 09/164,991

[22] Filed: Oct. 1, 1998

[30] Foreign Application Priority Data

Nov. 18, 1997 [GB] United Kingdom ..... 9724241

[51] Int. Cl.[7] ..... B65H 39/10

[52] U.S. Cl. ..... 271/293; 271/292; 271/294; 270/58.15; 270/58.12; 270/58.28; 270/58.18

[58] Field of Search ..... 270/58.18, 58.19, 270/58.15, 58.12, 58.28; 271/292, 293, 294

[56] References Cited

U.S. PATENT DOCUMENTS

| | | | |
|---|---|---|---|
| 4,328,963 | 5/1982 | DuBois et al. | 271/293 |
| 4,343,463 | 8/1982 | Lawrence | 271/293 |
| 4,397,461 | 8/1983 | Dubois et al. | 271/293 X |
| 4,466,609 | 8/1984 | Lawrence | 271/293 |
| 5,112,035 | 5/1992 | Yamamoto et al. | 271/293 X |
| 5,169,142 | 12/1992 | Muck et al. | 271/293 |
| 5,178,382 | 1/1993 | Chung et al. | 271/294 X |
| 5,180,152 | 1/1993 | Irie | 271/293 X |
| 5,692,411 | 12/1997 | Tamura | 271/292 X |

*Primary Examiner*—Christopher P. Ellis
*Assistant Examiner*—Richard Ridley

[57] ABSTRACT

An improvement in sheet sorters in which movable bins are incremented past a sheet entrance and the bins are cantilever-mounted and incremented in the sorter from only one side of the bins. The unsupported side or end of at least one of the cantilevered bins is temporarily supported to prevent its sagging from the weight of sheets loaded therein, or other causes. Specifically, the free end of the bin which is currently in position to receive sheets entering the sorter from the sheet entrance is supported by a small rotatably driven indexing bin support, such as a star-wheel, which is mounted to allow unrestricted access to the bins for the removal of stacks of sorted sheets.

5 Claims, 2 Drawing Sheets

CANTILEVERED BINS SHEET SORTER WITH INCREMENTING END SUPPORT

Figure 1:
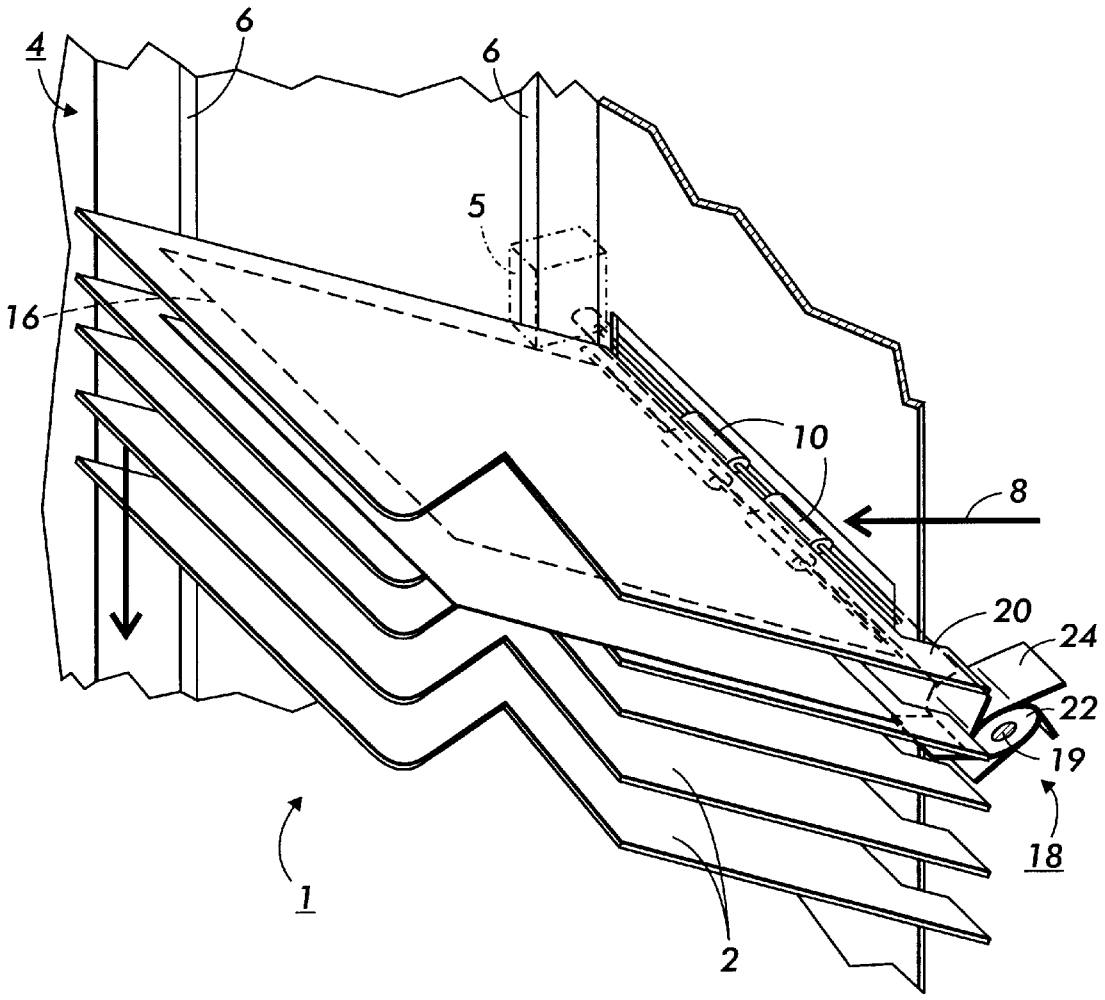

Priority is claimed from G.B. Application No. 97 242 41.6, filed Nov. 18, 1997.

This invention relates to sheet sorters, particularly of the indexible multi-bin type in which cantilevered bins are incrementally moved ('indexed') past a sheet inlet to the bins, so that sheets issuing in succession from the sheet inlet are incrementally received in adjacent bins.

A sorter is typically attached to, or part of, a copier or printer, to receive and collate its output of printed sheets. Although many such sorters have each bin supported both fore and aft, relative to the direction in which the sheets enter the sorter, other sorters have their bins cantilevered from one side, typically from a support tower or a copier or printer end wall at one side or the end of the sheet path therefrom. While spacers can be used on and between the outer unsupported ends of the bins for maintaining their mutual spacing, that can impede the necessary operator access into the bins to remove the sets of sheets therefrom, and has other disadvantages.

With a cantilevered bins arrangement, there is the possibility or likelihood that the unsupported outer ends of one or more of the bins will sag, leading to a space compression between bins and/or a misalignment between the bins and the paper path outlet nips which form the sheet inlet, which can interfere with the sorting function. This bin sag can come about because of the weight of the paper (multiple sheets) in the bin; working clearances, or abuse of the sorter by the operator or other users. The present invention addresses this and other related problems. The illustrated exemplary system provides a simple, compact, and low cost mechanism for supporting the bins from sagging.

By way of background, U.S. Pat. No. 4,328,963 discloses a sorter in which each bin is supported at least three regions, one to each side of the sheet path, and one at the end of the bins in line with the path. The bin ends are intended to remain in contact with each other at all times, with only the entry throats of the bins being enlarged, to form convergent pockets for the inserted sheets, as each bin comes into line with the inlet. U.S. Pat. No. 4,343,463 discloses an arrangement similar to that just described, with fixed end supports and movable side supports at the lead end of each bin. U.S. Pat. No. 4,397,461 also discloses a sorter of this type, with downward sloping bins. U.S. Pat. No. 4,466,609 discloses a tower sorter in which all the 10 bins are intended remain parallel to each other as they are moved up and down. Each bin has a pair of trunnions extending from it, on opposite sides of the paper path. Each trunnion is engaged by its own lifting means, so that the relative positions of all the trunnions projecting from each bin remain fixed. All four trunnions are adjacent to the lead edge of each bin, so that each bin is cantilever-mounted, with the outer unsupported end of each bin spaced from the sheet inlet. U.S. Pat. No. 5,169,142 discloses a rotatable open-mouthed "C" cam drive for incremental bin drive sorters wherein the open ends of the "C" cam on opposite sides of the open mouth provide bin engaging surfaces, the bin engaging surfaces comprising cantilevered arms allowing limited flexibility and reducing impact noise.

In contrast, in the sorter of the subject disclosed embodiment, although the bins are cantilever-mounted, extending from a single tower, there is an incrementing system for supporting at least one of the otherwise-free ends of a set of generally parallel bins when a bin is in position to take in fresh sheets from the sheet inlet, to prevent at least the bin so aligned with the sheet inlet from excessive sagging under the weight of the paper in the bin (to the extent of interference with proper sorting).

In the disclosed embodiment, there is shown, in a movable bins sheet sorter in which each bin of a set of bins is cantilever mounted to a tower from a first side, and is sequentially incrementally moved past a sheet entrance by a bin incrementing system, and wherein each said bin has a normally unsupported second side, the improvement comprising:

a rotatable bin support which is spaced from said tower and positioned to engage said unsupported second sides of said bins incrementally moved past said sheet entrance, said rotatable bin support having bin engagement areas for temporarily engaging and partially supporting at least one said bin when said bin is adjacent said sheet entrance, and said rotatable bin support being incrementally rotated by said bin incrementing system to sequentially support said bins on said bin engagement areas of said set of bins being incremented past said sheet entrance.

Other disclosed features of the embodiment include, those wherein said rotatable bin support comprises a star-wheel having plural flaps extending tangentially therefrom providing said bin engagement areas; and/or in which said star-wheel is dimensioned and positioned to have two of said flaps bear part of the weight of two adjacent said bins when said bins and said star-wheel are stationary; and/or in which said flaps are integral said star-wheel; and/or including a sheet transport for transporting each sheet into said sheet entrance along a sheet path on a third side of said bins which is remote from said tower and in between said first and second sides of said bins.

As another disclosed feature of the embodiment, there is provided a sheet sorter of the movable bins type, in which each bin is cantilevered from a tower located at one side of the sheet path into the sorter, the tower holding the bins generally parallel to each other and projecting into the sheet path, the tower incorporating means for transporting each sheet successively past a sheet inlet path, and in which, aligned with the sheet inlet, on the side of the sheet path remote from the tower, is a rotary support for the otherwise-free end of the bin which is currently in position to receive a sheet or sheets from the sheet inlet, the rotary support being coupled to the bin incrementing means or the sheet transport means to sequentially support one or more of the bins as the set of bins is translated past the sheet inlet.

Figure 2:
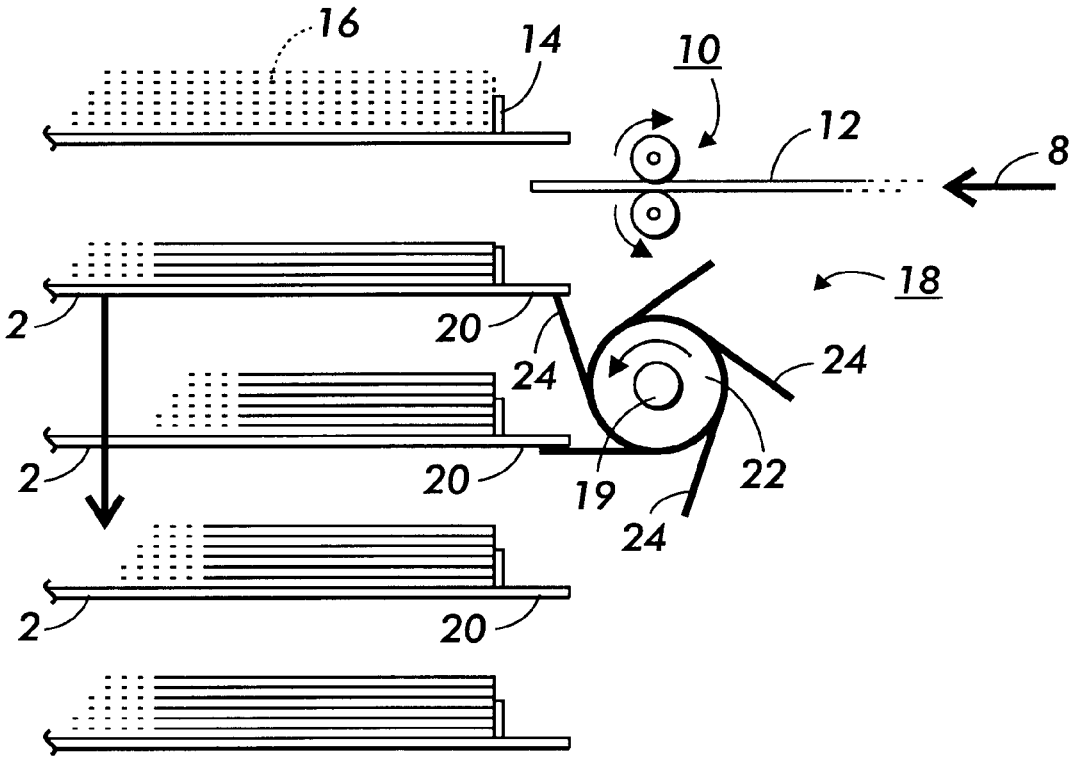

The following is a further description of one example or embodiment of the invention, with reference to the drawings, in which:

FIG. 1 is a schematic perspective view of one form of tower sorter incorporating the subject outer bin support embodiment, and FIG. 2 is an enlarged schematic side or end view of the area of the bins shown in FIG. 1, showing an end view of the outer support for each bin.

As shown in FIG. 1, the sorter 1 example here includes several otherwise identical bins 2 supported along one side edge from a sorter tower 4, by means of a pair of stub shafts (not shown) projecting from each bin and extending into channels 6 in the face of the tower 4. Within the tower 4, the bins stub shafts are engaged by any of various known bin incrementing means 5, shown in phantom, for lifting and lowering the bins. In known fashion, the bins may be lifted and lowered differentially so that the sheet pocket (inter-bin space) aligned with the sheet inlet may be significantly wider than the pockets between the other bins. However, as neither are part of the subject matter of the invention, they will not be described herein in any further detail, and examples are provided in the above-cited patents.

The direction of movement of the incoming sheets 12 in this example is shown by arrow 8, so that in this example the bins 2 are cantilevered across the width of the sheet path, rather than along the path, but the latter would be more typical. When a sorter is mounted on a copier, it is usual to have the sorter on the left-hand side or end of the copier. It can be seen that each bin 2 here is in the shape of a substantially rectangular sheet of metal or plastic, but with the front left-hand corner of each bin removed to enable the operator to more easily grip an accumulated stack of paper or other sheets by one corner thereof, to remove them from the sorter bins.

In this example, the sheets 12 leaving the copier in route to the sorter 1 to stack (16) therein are engaged by two pairs of sheet inlet nip rolls 10, of which one roll of each pair is driven directly, with the other, opposing, roll being driven by contact with the driven roll or the intervening sheet 12.

Each bin 2 preferably slopes upwardly from the inlet nip rolls 10, so that each sheet is slowed by gravity after it has left the rolls 10, in order to come to rest after it has traveled only a short distance over the sheet collecting surface provided by each bin 2. Although omitted from FIG. 1 for clarity, each bin 2 would also normally have an upstanding wall 14, as shown in FIG. 2, at its downhill end, to act as a registration surface for the trail edges of the sheets stacked on each bin 2. With this arrangement, when each bin 2 is incremented into the position aligned with the inlet nip rolls 10, the sheet leaving the nip rolls is at such a height from the bin stacking surface that it goes into the bin over the top of the wall 14 without touching it. The position of sheets at rest on each bin surface is indicated by the rectangle 16 shown in broken lines in FIG. 1.

Turning now to the exemplary improvement disclosed here, at least that bin which is to receive the next sheet to be discharged from the inlet nip rolls 10 is temporarily supported by a rotary support 18 at or adjacent its unsupported side or end. To facilitate this, each bin 2 may have an integral tab or extension which is intended to be contacted by the rotary support 18 as its turn comes to become aligned with the nip rolls 10.

In this illustrated embodiment, the rotary support 18 takes the form of a star-wheel mounted on a rotary shaft 19 which extends back (past the nip rolls) to, and operatively connects with, the bin incrementing mechanism 5 within the tower 4 for lifting and lowering (indexing) the bins 2 relative to the sheet inlet.

The star-wheel rotary support 18 here is in the form of a central hub 22 from which extend five tangential rigid arms or flaps 24 spaced equidistantly around the periphery of the hub 22.

As shown in FIG. 2, the length of each flap 24 is such that, when the star-wheel 18 is in one of its rest positions, the bin 2 which is currently in position to receive sheets from the nip rolls 10 has some of its weight borne by the respective engaging flap 24, which acts as a supporting strut for that bin at that point in time in the extended, otherwise unsupported, area of that bin. The next lower flap 24 (next in the counter-clockwise direction, as viewed) may, as shown, have the next-lower bin resting on it, to also stop that bin from sagging. The flaps 24 can be molded integrally with the rotary hub 22, or fastened to it. The flaps are each stiff and strong enough to bear at least part of the weight of a bin 2 having a stack of sheets resting on it. The dimensions of the star-wheel are related to the desired spacing between adjacent bins 2.

If, alternatively (not shown) the flaps are hinged to the hub, the flaps would be free to rotate in the clockwise direction (as viewed) so that they would be biased by gravity to flatten themselves against the hub 22 on one side, but would be constrained to move outwardly in the opposite direction only as far as becoming tangential to the hub 22. Thus, as the star-wheel rotated in the counter-clockwise direction as viewed, two hinged flaps would be biased by gravity to unfold themselves in succession from the hub 22 and pivot into the illustrated tangential positions in which they could bear their share of the weight of the respective bin 2. The provision of hinged flaps could thus provide an advantage of projecting less outwardly.

As the bins are incremented, the star-wheel 18 is also incremented by the bin incrementing mechanism 5, through a single partial revolution movement of about 72 degrees in the case of a star-wheel having five flaps. As the starwheel 18 rotates, one of its flaps remains in contact with one of the bins, while another of its flaps comes out of contact with another bin, and a third flap comes into contact with another bin, to arrive at the position shown in FIG. 2. It will be appreciated that the star-wheel may be rotated in either direction, depending on whether the set of bins is moving up or down.

Accordingly, the illustrated exemplary system provides a simple, small, and low cost mechanism for supporting the front edge of sorter bins cantilevered forward from a rearward tower sorter, yet with unimpeded operator access to the bins to remove sorted stacks of sheets therefrom.

While the terms "sorter" and sorting are used herein, it will be appreciated by those skilled in the art that the disclosed system is also applicable to printer mailboxing systems for separating pre-collated print jobs by users. Hence the term sorter as used herein encompasses such mailbox units.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In a movable bins sheet sorter in which each bin of a set of bins is cantilever mounted to a tower from a first side, and is sequentially incrementally moved past a sheet entrance, and wherein each said bin has a normally unsupported second side, the improvement comprising:

a rotatable bin support which is spaced from said tower and positioned to engage said unsupported second sides of said bins incrementally moved past said sheet entrance, said rotatable bin support having bin engagement areas for temporarily engaging and partially supporting at least one said bin with at least one said bin engagement area at said unsupported second side of said bin when said bin is adjacent said sheet entrance, and an incrementing system for incrementing said rotatable bin support to sequentially support said unsupported second sides of said bins on said bin engagement areas as said set of bins is sequentially incremented past said sheet entrance.

2. A sorter according to claim 1, in which said rotatable bin support comprises a star-wheel having plural flaps extending therefrom providing for said bin engagement areas.

3. A sorter according to claim 2, in which said star-wheel is dimensioned and positioned to have two of said plural flaps bear part of the weight of said unsupported second sides of two adjacent said bins when said bins and said star-wheel are stationary.

4. A sorter according to claim 2, in which said flaps are integral said star-wheel.

5. A sorter according to claim 1, including a sheet transport for transporting each sheet into said sheet entrance along a sheet path on a third side of said bins which is remote from said tower and in between said first and second sides of said bins.

* * * * *